United States Patent [19]

Sainio

[11] Patent Number: 4,913,049

[45] Date of Patent: Apr. 3, 1990

[54] BERNOULLI-EFFECT WEB STABILIZER

[75] Inventor: Jeffrey W. Sainio, Hartland, Wis.

[73] Assignee: Quad/Tech, Inc., Pewaukee, Wis.

[21] Appl. No.: 340,498

[22] Filed: Apr. 19, 1989

[51] Int. Cl.[4] ..... B41M 1/14

[52] U.S. Cl. ..... 101/211; 101/484; 101/225; 226/7; 226/45; 226/30

[58] Field of Search ..... 101/225, 227, 176, 178–180, 101/211, 484, 219, 220, 228, 229, 232; 226/5, 7, 29–31, 38, 45

[56] References Cited

U.S. PATENT DOCUMENTS

| | | | |
|---|---|---|---|
| 3,147,006 | 9/1964 | Fulk | 101/227 |
| 3,622,058 | 11/1971 | Vits | 226/7 |
| 4,038,917 | 8/1977 | Deligt | 226/7 |
| 4,096,801 | 6/1978 | Martin | 101/227 |
| 4,137,644 | 2/1979 | Karlsson | 226/7 |
| 4,240,346 | 12/1980 | Landis et al. | 101/225 |
| 4,321,107 | 3/1982 | Page | 226/7 |
| 4,342,413 | 8/1982 | Reba | 226/7 |
| 4,366,753 | 1/1983 | Glanz et al. | 101/227 |
| 4,453,709 | 6/1984 | Reba | 226/7 |
| 4,541,337 | 9/1985 | Schaul | 101/227 |

OTHER PUBLICATIONS

Three page Bertin & Cie brochure entitled "Calgraph Systeme" Control de reperage (Register Control), 4--7-89.

*Primary Examiner*—Eugene H. Eickholt
*Attorney, Agent, or Firm*—Foley & Lardner

[57] ABSTRACT

A system and method for generating indicia of registration error between respective, separately adjustable printing units of a printing press, the printing units cooperating to print an image on a moving web, the system being of the type comprising a photo-optical control, having a field of view and depth-of-field, for generating output signals indicative of a predetermined relative disposition of marks on a web passing through the field of view within the depth-of-field of the photo-optical control as the web moves in relation to the printing units, and processing circuits, responsive to the photo-optical output signals, for generating signals indicative of deviations of the registration marks printed by the printing units from the predetermined relative disposition; improved wherein:

the photo-optical control is disposed proximate to the printing units, and, having associated therewith an air driven stabilizer structure for maintaining the web within the depth of field by creating a Bernoulli effect.

20 Claims, 9 Drawing Sheets

BERNOULLI-EFFECT WEB STABILIZER

TECHNICAL FIELD

The present invention relates, generally, to mechanisms for stabilizing a moving web and to control systems for adjusting the color-to-color registration of multicolor web-fed printing press systems by stabilizing and optically scanning the web, and more particularly, to methods and apparatus for stabilizing the web without contact, thereby facilitating low depth-of-field scanning of the web in proximity to the print unit.

BACKGROUND OF THE INVENTION

In multicolor web-fed printing press systems, a web of material (e.g., paper) is sequentially driven through a series of printing units, each comprising a plate cylinder and a print cylinder (blanket cylinder). Each blanket cylinder contacts the web in sequence and applies a different color of ink thereto, which colors cooperate to imprint a multicolor image on the web. As the web exits the printing units, the ink is still wet, and thus subject to smearing. Accordingly, before further processing, the web is typically routed through a drying unit to dry the image, heating the web to evaporate various solvents in the ink, then to a chill roller unit to cool the web and set the ink.

To provide an accurate and clear multicolor image, the rotational and lateral position of each blanket cylinder must be precisely aligned, i.e., proper registration of the respective colors must be maintained. Historically, the registration of the various print cylinders in multicolor systems was maintained manually. A pressman would examine signatures (printed images) at the output of the press, and manually enter estimated lateral and rotational offset values into an electromechanical register control system to effect the necessary corrections. Maintenance of color registration in such systems requires the constant attention of the pressman since registration is often lost due to a number of uncontrollable variables in the web material and press hardware.

Automatic registration control systems for multicolor web-fed printing press systems are, in general, known. For example, commercially available closed loop register control systems utilize an optical scanning device cooperating with register marks printed on the web by the individual cylinders, to provide position feedback information indicative of the registration of the respective print cylinders relative to a designated reference print cylinder. More particularly, each print cylinder produces a specific register mark forming part of a register pattern. The optical sensor generates a signal indicative of the register pattern, which is analyzed to determine the lateral and rotational registration of the respective print cylinders vis-a-vis the reference cylinder. Registration error signals, produced in accordance with the registration pattern, are employed to effect position correction of the respective print cylinders. Examples of such systems are described in EPO Application No. 87 104 973.0, filed April 3, 1987, and U.S. Ser. No. 849,095, filed July 2, 1986 by the present inventor, both applications commonly assigned herewith.

Optimal scanning accuracy may be achieved when the web is scanned under conditions yielding relatively little web "weave" (spurious lateral movement of the web, e.g., movement transverse to the direction of web travel, in the plane of the web) and "flutter" (spurious movement of the web in a direction perpendicular to the plane of the web). Preprinted control marks are preferably as small and unobtrusive as possible. However, the ability of the scanner to accurately detect the presence and position of a mark tends to be inversely proportional to mark size; the smaller the mark, the more likely that misregistration or web weave will take the mark outside of the field of view of the scanner. While use of a small and unobtrusive mark can be facilitated by use of a line scanner, as in the aforementioned Sainio U.S. Ser. No. 849,095 (RGS IV), substantial web weave may cause the scanner to lose track of the mark, necessitating reacquisition of the mark by the registration system or, in some cases, physical translation of the scanner to bring the mark back into the field of view of the optical scanner. Reacquisition of the mark can require a significant amount of time in the context of system operation, thereby impairing scanning efficiency.

In addition, optical scanners tend to have a relatively limited depth-of-field, i.e., they are capable of accurately sensing only those images within a predetermined range of distance from the scanner, typically on the order of approximately 0.025 inches. Thus, web flutter in the vicinity of the scanner should be maintained within the limits of the scanner depth-of-field. In prior art systems, flutter is typically maintained within acceptable limits by physically restraining the web, e.g., scanning the web as it wraps around an idler roller, or the like, or in the vicinity of such a wrap.

It is desirable that misregistration be detected as quickly as possible after printing, i.e., that the web be scanned as early in the process after the printing operation as possible. At high web speeds (e.g. 2000 feet per minute), relatively short delays in detecting misregistration can cause considerable wastage.

A principal source of web flutter is observed at the line of contact between the web and the final print cylinder as the web leaves the printing stage. The ink applied to the web by the print cylinder is tacky when moist, causing the web to adhere to the outer circumference of the print cylinder. In regions of high image density, the adhesion is relatively strong; in regions of low image density, the adhesion is relatively weak. Localized fluctuations in web tension as the web is pulled from the print cylinder surface cause the web to flutter with an amplitude in the range of about 3/16 to ¼ inch in the vicinity of the final print cylinder, far beyond the maximum depth-of-field variations tolerated by commercially available scanners (e.g. 0.025 inches). Accordingly, to maintain flutter amplitude within the depth-of-field limits of the scanner, flutter amplitude must be reduced by approximately a factor of ten between the point at which the web leaves the print cylinders and the point at which the web surface is scanned.

Conventional web stabilizing techniques, which require physical contact with the web, are not suitable for use upstream of the chill roller; to avoid marring the printed image, physical contact with the web surface is not advisable until after the ink has fully dried. When the web emerges from the dryer, the flutter amplitude is typically less than 0.010 inches, well within the acceptable depth-of-field range of available scanners. The drying unit typically supports the horizontally oriented web using pressurized air simultaneously directed at the upper and lower surfaces of the web. This tends to dampen the flutter interjected by the printing units, effectively stabilizing the web during the drying operation. However, changes in the drying air pressure can cause the web to shift up or down relative to the scanner, resulting in unwanted low frequency depth-of-field variations. Moreover, various web characteristics can cause the web to dry at different rates along the length thereof, resulting in non-uniform shrinkage or expansion of the web. This can result in web weave, on the order of about ½ inch. This is compounded by periodic cleaning of the blanket cylinders (known as a "blanket wash"). A blanket wash obliterates registration marks, and often makes the web weave; the marks disappear, then reappear in a different lateral location due to the web weave caused by the blanket wash. Thus, the register control system almost invariably loses "track" of the mark, and must reacquire the mark after a blanket wash. This, of course, delays correction of misregistration. In addition, a web typically travels between 100 and 160 feet between the point at which the web emerges from the printing units and the point at which the web emerges from the dryer. Considerable wastage results from the delay in detecting misregistration. Thus, a technique is needed for stabilizing the web, without contact, prior to the drying operation.

Several mechanisms which turn or support the web without touching it, using a cushion of air, are commercially available. An example is the Tec Systems Tec-Turn(R), which turns a web of paper approximately 90 degrees upward into an overhead dryer. The Tec-Turn unit is adequate for turning, but the distance from the air outlet to the paper may vary from a few hundredths of an inch to ¼ inch, depending on paper tension and air pressure. This is adequate for turning the paper but inadequate for keeping the paper within the practical focusing range of a scanner.

Attempts have been made to increase the depth of focus of scanners employing complex optics, thereby facilitating scanning under conditions of high amplitude flutter. For example, the Caligraph System by Bertin may be mounted after the printing groups and before the drier. Such systems, however, have tended to be impractical, overly bulky, and expensive.

SUMMARY OF THE INVENTION

The present invention facilitates enhanced closed loop register control by stabilizing the printed web as it leaves the final print cylinder, thereby allowing tighter control of color-to-color registration by minimizing the amount of web travel between the printing operation and the scanning operation. In accordance with one aspect of the present invention, a Bernoulli-effect stabilizer is disposed proximate the point at which the web leaves the print cylinders. A scanner, mounted in the vicinity of the stabilizer accurately detects the desired printed image within a narrowly circumscribed depth-of-field.

BRIEF DESCRIPTION OF THE DRAWING

A preferred exemplary embodiment of the present invention will hereinafter be described in conjunction with the appended drawing, wherein like numerals denote like elements, and.

DETAILED DESCRIPTION OF PREFERRED EXEMPLARY EMBODIMENTS

Figure 1:
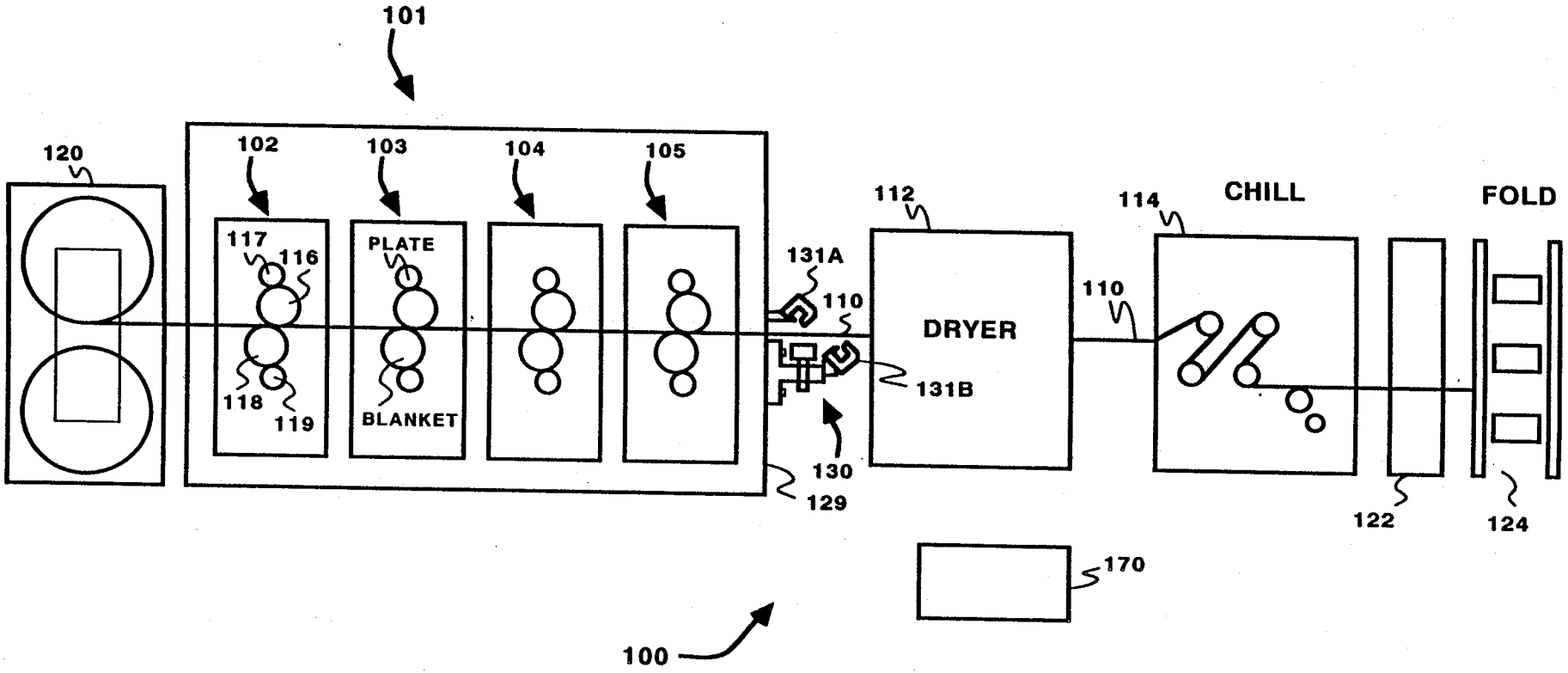
FIG. 1 is a block schematic front elevation view of a printing system in accordance with the present invention.

Referring now to FIG. 1, a web-fed printing system 100, preferably including a printing press 101 and comprising a plurality of serially disposed conventional printing units 102, 103, 104, and 105, operates upon a driven web 110. In a web offset printing press, each of printing units 102–105 advantageously includes an upper blanket cylinder 116, an upper plate cylinder 117, a lower blanket cylinder 118, and a lower plate cylinder 119. Web 110, typically paper, is fed from a reel stand 120 through each of printing units 102–105 in sequence and thereafter through a dryer unit 112 and chill unit 114. Web 110 is then suitably guided through a coating unit 122 and a folding station 124 which folds and separates the web into individual signatures.

Printing units 102–105 cooperate to imprint multicolor images on the upper and lower surfaces of web 110. Each printing unit 102–105 prints an associated color of ink; typically the first sequential print unit 102 prints the color black, and subsequent units 103–105 print other colors such as cyan, magenta, and yellow. Print unit 105 is referred to herein as the terminal print unit. Each of the lateral and rotational positions of upper and lower plate cylinders 117, 119 is separately controlled by electric motors (not shown) to precisely register the respective images generated by the individual printing units.

In accordance with one aspect of the present invention, a non-invasive stabilizer is employed to facilitate scanning of the web, between the individual printing units 102–105, immediately upon exit from press 101, or otherwise between press 101 and dryer 112. In the embodiment of FIG. 1, a non-invasive stabilizer 130 is advantageously mounted to a side frame 129 of printing press 101. One or more optical scanning units 131A, 131B, associated with a register control system 170, such as, for example, a Quad/Tech RGSIV register control system, are disposed to scan web 110 in a stabilized area in the vicinity of stabilizer 130. Register control system 170 provides appropriate signals to the electric motors of the plate cylinders to precisely control lateral and rotational position of the upper and lower plate cylinders, respectively.

By employing a non-invasive stabilizer 130, i.e., a stabilizer which does not make physical contact with the web, scanning can be advantageously effected in the vicinity of the print units without smearing the ink. In view of the proximity of the scanners to the printing units, not only are long time delays between printing and detection of misregistration substantially eliminated, but web weave is minimized. Stabilizer 130 can be any mechanism which dampens flutter of web 110 to within acceptable limits for scanning (i.e., within the depth-of-field of units 131A, 131B), without causing the image imprinted on the respective surfaces of web 110 to smear. Stabilizer 130 can, for example, comprise respective forced-air conduits, disposed on either side of web 110, including apertures to generate respective oppositely directed air streams impinging on both the upper and lower surface of web 110 with sufficient force to stabilize the web. In accordance with the preferred embodiment, however, stabilizer 130 employs a Bernoulli-effect to stabilize web 110.

Figure 2:
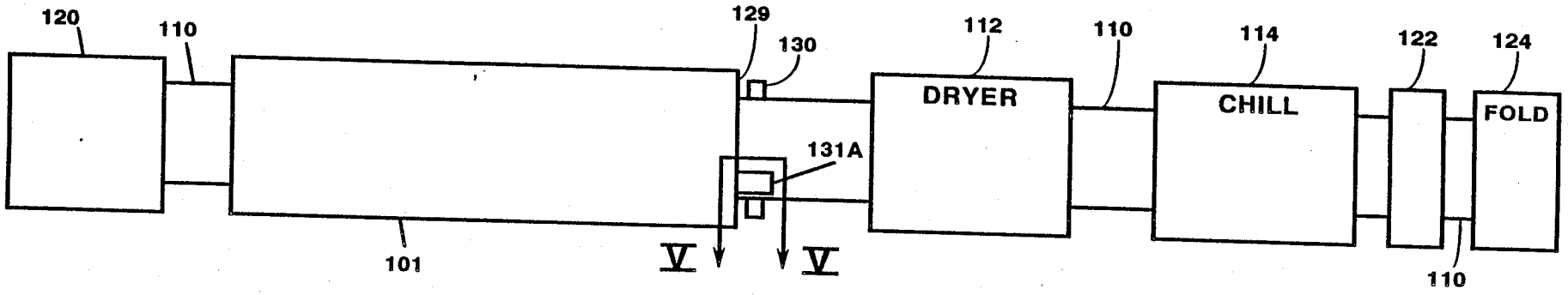
FIG. 2 is a block schematic top plan view of the printing press of FIG. 1.
Figure 3:
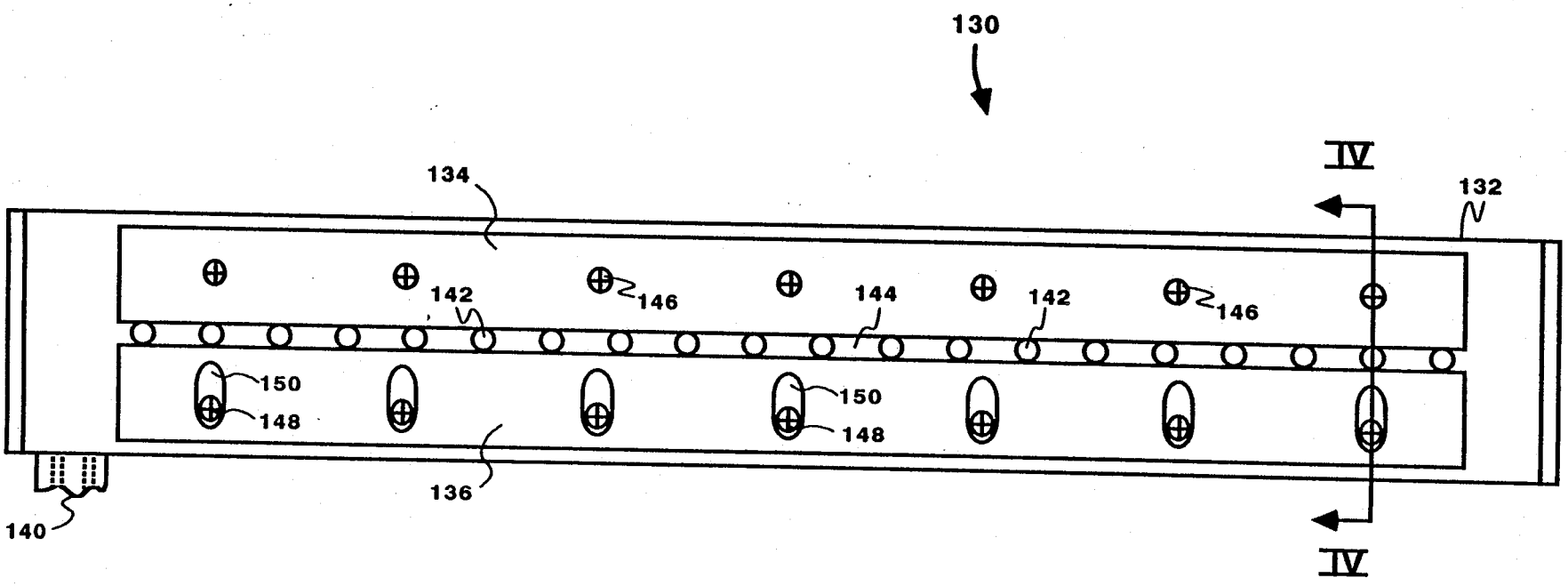
FIG. 3 is a top plan view of the stabilizer of FIGS. 1 and 2.

As shown in FIGS. 2 and 3, stabilizer 130 preferably comprises a forced air conduit bar 132 disposed transverse to the direction of web travel, extending across the width of web 110. Stabilizer 130 directs a stream of pressurized air, transverse to the plane of the web, against the surface of the web. As the forced air impinges upon the moving web, the air moves horizontally along the downward facing surface of the web, away from stabilizer 130. This high velocity air creates a zone of reduced static pressure adjacent the surface of the web, thereby pulling the web toward the stabilizer. At the same time, the outward pressure of the forced air, in conjunction with the pocket of high velocity air trapped between the web surface and the stabilizer surface, prevents the web from contacting the stabilizer. Accordingly, as flutter induces the web away from the stabilizer, the Bernoulli effect pulls the web back towards the stabilizer. Conversely, as flutter attempts to direct the web into contact with the stabilizer, the trapped air pushes the web away therefrom. As will be explained, a plurality of stabilizer units may be simultaneously employed, for example, above and below the web, as desired. For purposes of illustration, the preferred embodiment will be described in the context of a single stabilizer disposed underneath the web.

Figure 4:
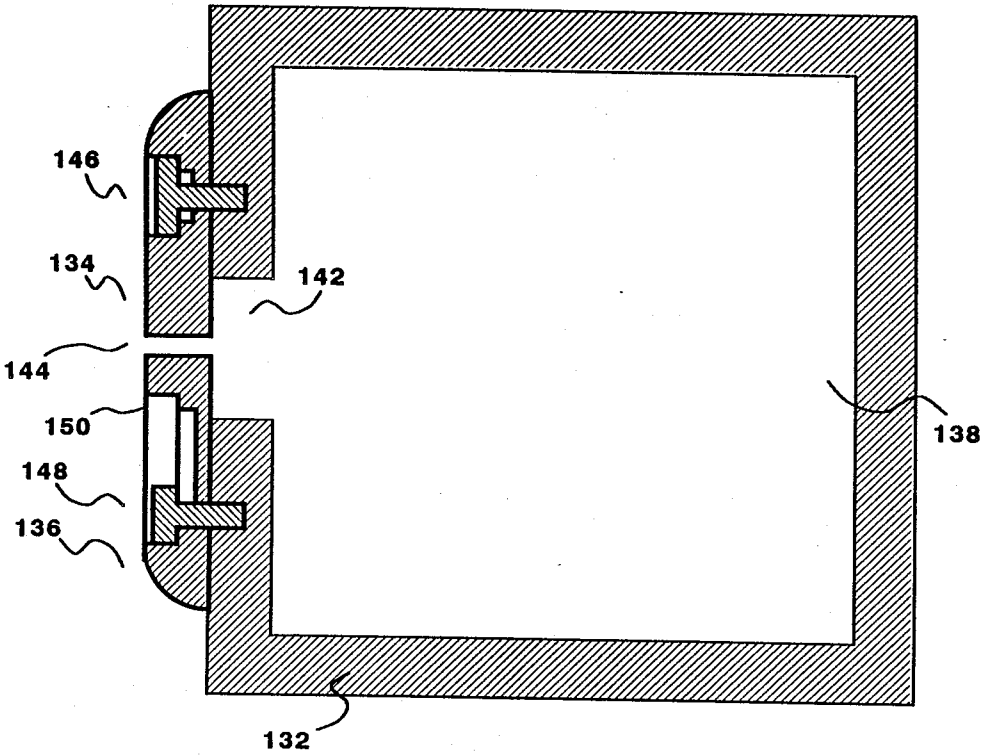
FIG. 4 is a cross-section view of the stabilizer shown along line IV—IV of FIG. 3.

Referring now to FIGS. 3 and 4, conduit bar 132 is suitably square in cross-section and of a length, e.g., 52 inches, in excess of the width of web 110. A hollow interior chamber 138 spans the length of the bar, the cross-sectional area of chamber 138 being sufficient to accommodate a desired air flow, suitably on the order of 2 to 10 PSI, preferably within the range of 2 to 4 PSI. Chamber 138 communicates with a compressed air source (not shown) through an air inlet junction 140 suitably disposed at an end of bar 132.

A controlled air stream outflow is provided from the surface of conduit bar 132 facing web 110. A series of air discharge holes 142 are formed through the wall of bar 132 along the length of bar 132. Respective gap adjusting strips 134 and 136 are secured to the surface of bar 132. Adjusting strips 134 and 136 cooperate to define a linear gap 144 therebetween generally overlying holes 142, preferably of a length corresponding to the width of web 110. Holes 142 and gap 144 define the path of discharged air from conduit bar 132, and thus the air stream against web 110. The use of holes 142, and overlying strips 134, 136, to provide and control the air flow is particularly advantageous; it provides a structure mechanically strong enough to operate at relatively high air pressures without deformation of the air outlet. The square cross section of conduit 132 facilitates formation of holes 142, and the securing of strips 134 and 136.

Proper selection of the width of gap 144 allows precise control over the velocity of the discharge air passing therethrough. For a given air pressure within chamber 138, decreasing the width of gap 144 increases the discharge air speed; conversely, increasing the width of gap 144 decreases the discharge air speed.

The width of gap 144 is preferably such that gap 144 provides a significant resistance to air flow, greatly in excess of the resistance generated by the presence of web 110 in the vicinity of gap 144. Thus, air flow through gap 144 will be substantially constant across the length of the gap whether or not web 110 extends across the entire length of gap 144. Webs of varying widths are therefore readily accommodated; gap 144 is of a length corresponding to the widest web contemplated to be encountered. The width of gap 144 is suitably on the order of eight to fifteen thousandths of an inch (0.008 to 0.015 inch).

Strip 134 is secured to bar 132 in any convenient manner, for example by bolts 146. Alternatively, strip 134 may be held in place by screws, welding, or may be formed integral with bar 132, as desired. Adjusting strip 136, on the other hand, is preferably slideably secured to bar 132, for example by respective slotted screws 148 received within slots 150. In this way, the width of gap 144 may be adjusted by disposing and securing strip 136 at a predetermined desired distance from strip 134. Of course, if desired, both strips 134 and 136 may be fixedly secured to conduit bar 132.

Figure 5:
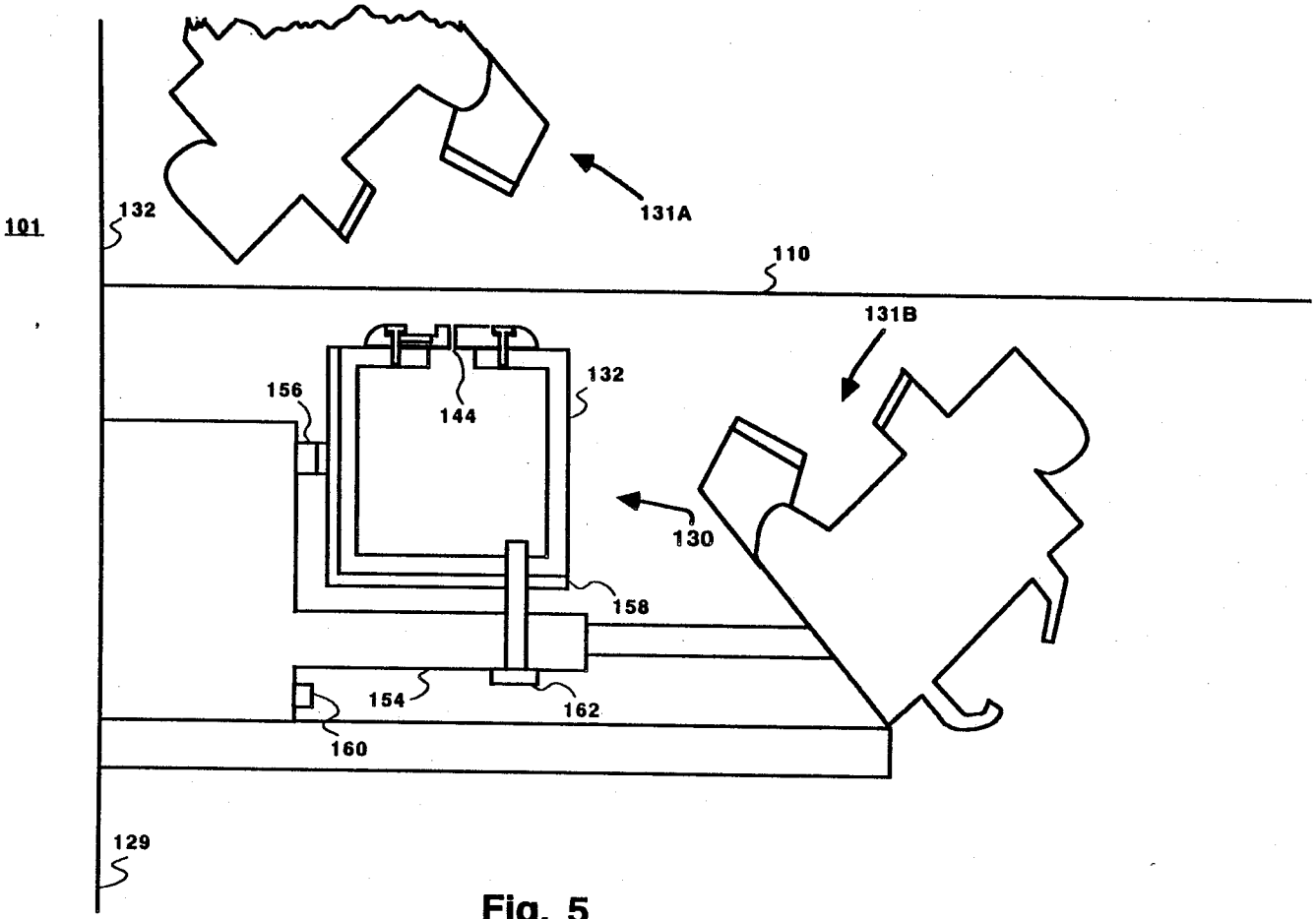
FIG. 5 is a cross-section view of the stabilizer shown mounted to the press taken along line V—V of FIG. 2.

Referring now to FIG. 5, stabilizer apparatus 130 is advantageously mounted to press 101 near the point at which web 110 leaves press 101. In a preferred embodiment, a mounting member 154 is affixed to press frame 129, for example, by an upper bolt 156 and a lower bolt 160. An L-shaped bracket 158 is secured to mounting member 154, for example by bolt 156 and a medial bolt 162. Bar 132 of stabilizer 130 is received within L-shaped bracket 158 and secured thereto by, for example, one or both of bolts 156 and 162. Mounting member 154 and L-shaped bracket 158 suitably span approximately the entire length of bar 132, and a plurality of bolts 156, 160, and 162, spaced apart along the length of mounting member 154, may be used as necessary.

Scanner 131B is suitably mounted to sidewall 129 of press 101, or to mounting bracket 154, and disposed to focus upon an area of web 110 in the vicinity of stabilizer 130. Scanner 131B is suitably focused on an area of the web within, e.g., five or six inches from stabilizer 130. Scanner 131A is suitably mounted to the side of press 101 on the opposite side of web 110 from stabilizer 130. Scanner 131A is suitably focused on a portion of web 110 overlying stabilizer 130. The point of focus is preferably not directly over gap 144; there tends to be little if any Bernoulli effect immediately overlying gap 144, causing a slight pucker in the web immediately above gap 144. Accordingly, the point of focus preferably overlies one of adjusting bars 134 or 136.

Figure 6:
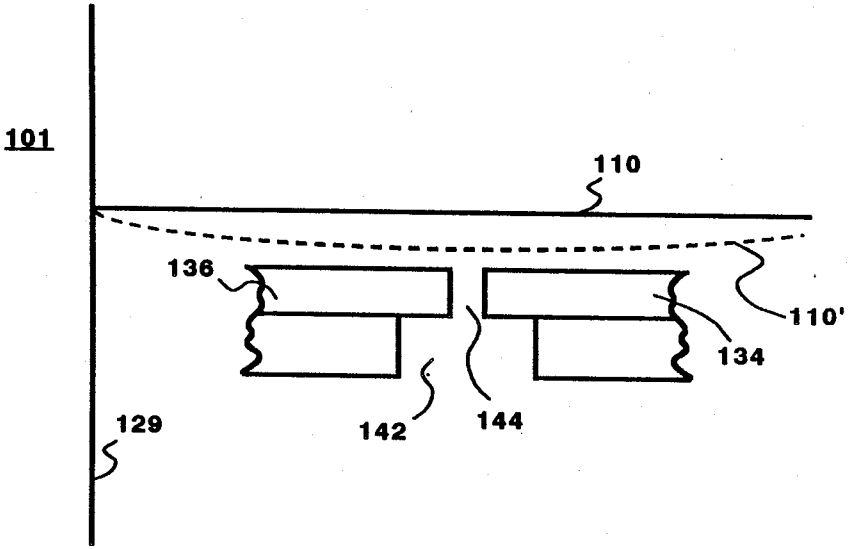
FIG. 6 is an enlarged view of the stabilizer of FIGS. 3–5 shown interacting with a moving web.

Referring now to FIG. 6, stabilizer 130 is advantageously mounted such that the upper surfaces of respective adjusting strips 134 and 136 are disposed approximately 3/16 of an inch from web 110 when the stabilizer is in the off condition. When the stabilizer is turned on, compressed air is forced upwardly through respective holes 142 and gap 144, ultimately impinging upon the downward facing surface of web 110. The pressure of the discharged air which is confined between the upper surfaces of strips 134, 136 and the underside of web 110 creates a cushion of horizontally moving air; the velocity of this air creates a zone of reduced static pressure between the stabilizer and the web in accordance with the Bernoulli principle. The static pressure above the web, of course, remains unaffected by the operation of the stabilizer. Consequently, web 110 is drawn towards the stabilizer to the position 110', as indicated by the phantom line in FIG. 6. The upward force of the discharged air, in conjunction with the cushion of trapped air between web 110' and adjusting strips 134, 136, prevents web 110' from contacting the stabilizer. Proper adjustment of web tension, air pressure, and the width of gap 144 permits the distance between web 110' and stabilizer 130 to be maintained within the range of about 0.001 to 0.010 inches, and most preferably about 0.007 inches.

Figure 7:
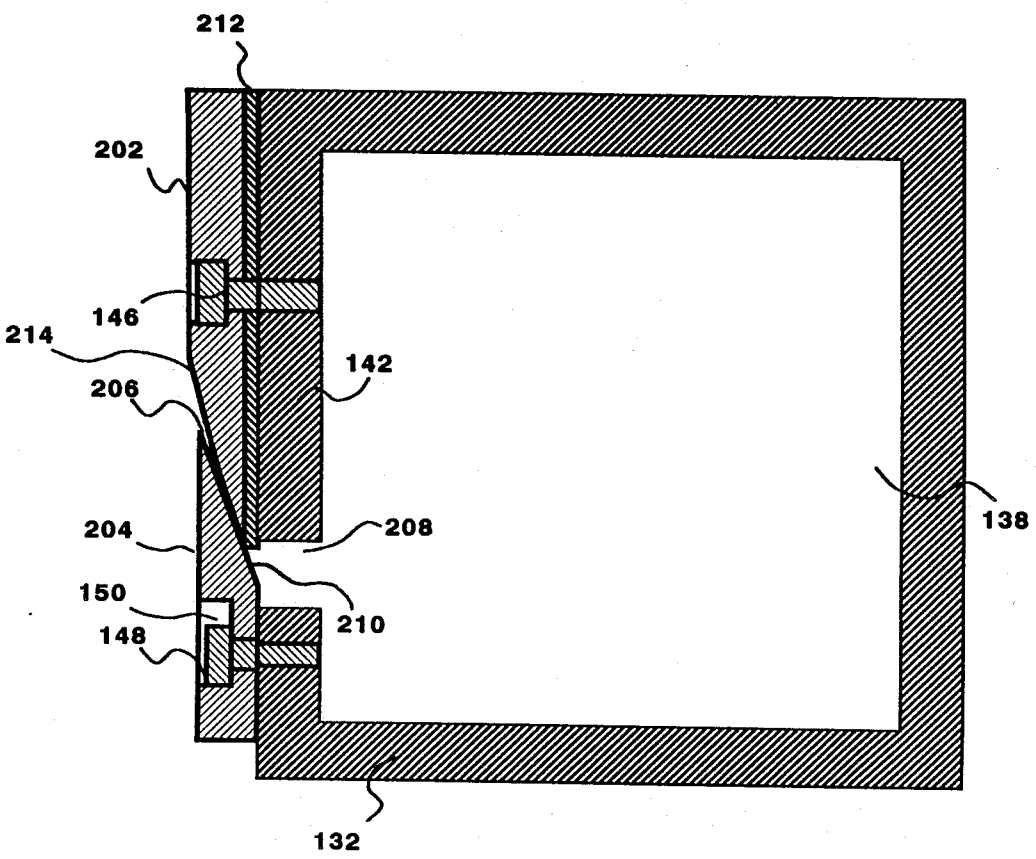
FIG. 7 is a top plan view of an alternate embodiment of the stabilizer of FIGS. 1 and 2.
Figure 8:
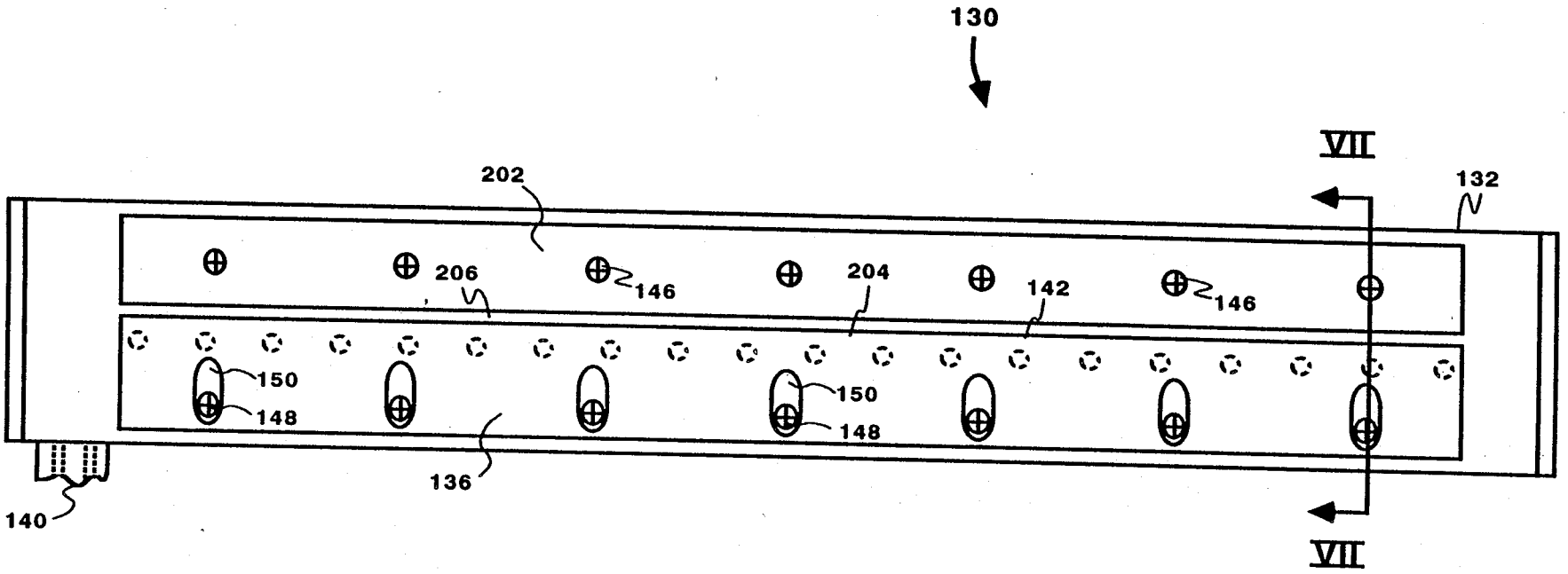
FIG. 8 is a cross-section view of the stabilizer shown along line VIII—VIII of FIG. 7.

Referring now to FIGS. 7 and 8, an alternate exemplary embodiment of the stabilizer bar in accordance with the present invention suitably comprises respective gap adjusting strips 202 and 204 defining an angled air gap 206 therebetween. Gap adjusting strip 204 is suitably secured to conduit bar 132 by slotted screw 148 received within slot 150, as described above in connection with strip 136.

Gap adjusting strip 204 advantageously comprises an angled portion 210 defining an acute angle with the surface of conduit bar 132 upon which respective holes 208 are disposed. Gap adjusting strip 202 is advantageously secured to conduit bar 132 in any convenient manner, for example by bolts 146. A spacer 212 is advantageously disposed intermediate gap adjusting strip 202 and conduit bar 132 such that, when stabilizer 130 is mounted to side frame 129 of press 101 as depicted in FIG. 9, the height of gap adjusting strip 202 exceeds that of strip 204 by an amount approximately equal to the thickness of spacer 212, for example, approximately 0.060 inches.

Figure 9:
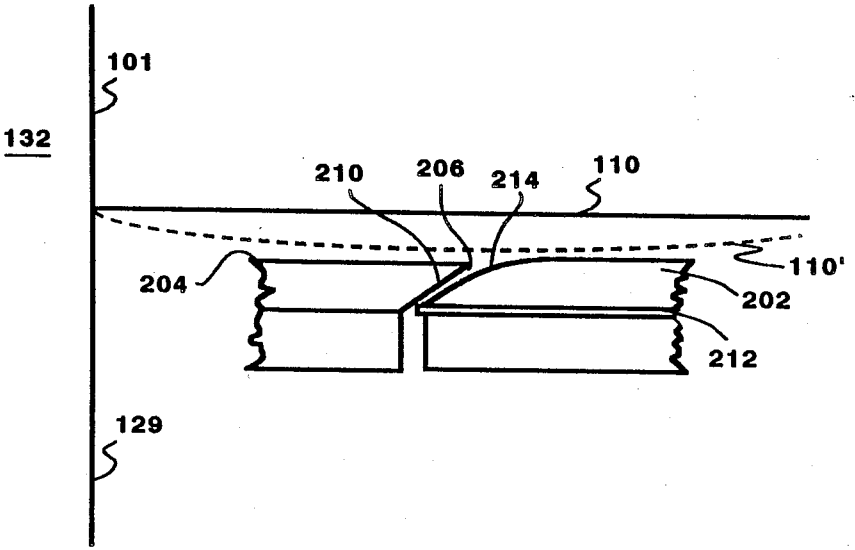
FIG. 9 is an enlarged view of the stabilizer of FIGS. 7–8 shown interacting with a moving web.

With continued reference to FIGS. 7–9, strip 202 suitably comprises an inclined portion 214 defining the downstream edge of gap 206; angled portion 210 of strip 204 comprises the upstream edge of gap 206. As a result of the angled configuration f gap 206, the stream of discharged air from stabilizer 130 impinges web 110 at an acute angle with respect to the plane of travel of web 110. In this manner, a relatively insignificant amount of discharge air enters the region between the web and the upper surface of strip 204, the majority of the discharge air being directed between the web and strip 202. Consequently, the Bernoulli effect is largely confined to that portion of stabilizer 130 downstream of gap 206. Any debris which may fall from the web, for example sputtered ink, dust, and the like, will thus be blown downstream by the airstream discharged from gap 206.

To avoid contact between strip 204 and web 110' when web 110' is in the control (stabilization) zone, i.e., approximately 0.007 inches from adjusting strip 202 during operation of stabilizer 130, it is advantageous for strip 204 to be disposed out of (beneath) the control zone by an amount approximately equal to the thickness of spacer 21.

It will be understood that the above description of is preferred exemplary embodiments of the present invention, and that the invention is not limited to the specific forms described. For example, the web stabilizer need not be secured to the side frame of the printing press; the stabilizer may be disposed at any convenient point along the web path, although proximity to the source of flutter, i.e., the print cylinders, is advantageous. Furthermore, although the preferred embodiment employs a Bernoulli-effect stabilizer, any suitable technique for dampening web flutter which does not smear the ink is satisfactory. These and other substitutions, modifications, changes, and omissions may be made in the design and arrangement of the elements without departing from the scope of the appended claims.

I claim:

1. A method of maintaining registration control of a multicolor, web-fed printing press, comprising the steps of:

guiding a web through a series of print cylinders having respective correction motors associated therewith, to apply a printed image to the web;

directing compressed air at the surface of the web to stabilize the web such that web flutter is confined to a predetermined depth-of-field;

scanning said image with an optical scanner capable of scanning within said depth-of-field, said scanner being configured to produce output signals in accordance with said image;

thereafter drying said image; and transmitting said output signals to said motors.

2. The method of claim 1 wherein said directing step comprises reducing said flutter to within the range of about 0.025 inches.

3. The method of claim 1, wherein said directing step comprises creating a cushion of air moving at a velocity sufficient to create a zone of reduced static pressure between said web and said stabilizer bar.

4. The method of claim 3, wherein said directing step comprises pulling said web towards said stabilizer bar while preventing said web from contacting said stabilizer bar.

5. The method of claim 1 wherein said directing step further includes moving compressed air horizontally about the downward facing surface of said web.

6. The method of claim 1, wherein said scanning step comprises scanning said image proximate said print cylinders.

7. A system for generating indicia of registration error between respective, separately adjustable printing units of a printing press, said printing units cooperating to print an image on a moving web, the system being of the type comprising photo-optical means, having a field of view and depth-of-field, for generating output signals indicative of a predetermined relative disposition of marks on said web passing through said field of view within said depth-of-field of said photo-optical means as said web moves in relation to said printing units, and processing means, responsive to said photo-optical means output signals, for generating signals indicative of deviations of the registration marks printed by said printing units from said predetermined relative disposition; improved wherein:

said photo-optical means is disposed proximate to said printing units, and, having associated therewith air driven stabilizer means for maintaining said web within said depth of field.

8. The system of claim 7 wherein said photo-optical means is mounted on the last of said printing units.

9. The system of claim 7 wherein said stabilizer means comprises means for creating a zone of reduced air pressure for drawing said web in a direction normal to the plane of said web.

10. The system of claim 9 wherein said stabilizer means comprises means for creating a Bernoulli effect.

11. The system of claim 7 wherein said stabilizer means comprises a non-invasive stabilizer bar.

12. The system of claim 7, wherein said stabilizer means comprises at least one bar, including a forced-air conduits, disposed transverse to the direction of web travel and extending across the width of said web.

13. The system of claim 12, wherein said stabilizer means comprises respective forced-air conduits disposed above and below the surface of said web.

14. The system of claim 13, wherein said conduits include apertures configured to generate respectively oppositely directed air streams which impinge upon the upper and lower surfaces of said web.

15. The system of claim 12, wherein said bar is configured to direct a stream of pressurized air, in a direction transverse to the plane of said web, against the undersurface of said web.

16. The system of claim 7, wherein said stabilizer means comprises a stabilizer bar having a rectilinear cross section.

17. The system of claim 16, wherein said bar is disposed across the width of said web and has a length at least as great as the width of said web.

18. The system of claim 17, wherein said bar comprises a hollow interior chamber spanning the length of said bar.

19. The system of claim 7, wherein said stabilizer means comprises a non-invasive stabilizer bar having a plurality of holes disposed on a surface thereof, and respective first and second adjusting strips secured to said surface defining a linear gap overlying said holes, wherein said holes and said gap define a path of discharged air from said bar.

20. The system of claim 19, wherein said photo-optical means comprises a scanner disposed to focus on an area of said web proximate said adjusting strips.

* * * * *